US009571945B2

(12) United States Patent
Yun et al.

(10) Patent No.: US 9,571,945 B2
(45) Date of Patent: Feb. 14, 2017

(54) HEARING AID HAVING RECEIVER

(71) Applicant: Samsung Electronics Co., Ltd., Gyeonggi-do (KR)

(72) Inventors: Yongsang Yun, Gyeonggi-do (KR); Byounguk Yoon, Gyeonggi-do (KR); Changryong Heo, Gyeonggi-do (KR); Ohyong Kwon, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/549,336

(22) Filed: Nov. 20, 2014

(65) Prior Publication Data

US 2015/0156593 A1 Jun. 4, 2015

(30) Foreign Application Priority Data

Nov. 21, 2013 (KR) ..... 10-2013-0141884

(51) Int. Cl.
*H04R 25/00* (2006.01)

(52) U.S. Cl.
CPC ..... *H04R 25/60* (2013.01); *H04R 25/604* (2013.01); *H04R 25/65* (2013.01); *H04R 25/658* (2013.01); *H04R 2225/021* (2013.01); *H04R 2225/025* (2013.01); *H04R 2225/63* (2013.01)

(58) Field of Classification Search
CPC ..... H04R 25/60; H04R 25/602; H04R 25/604; H04R 25/65; H04R 25/652; H04R 25/656; H04R 25/658; H04R 2225/021; H04R 2225/023; H04R 2225/025; H04R 2225/63; H04R 2460/09
USPC ..... 381/322, 324, 325, 328, 329, 330, 380,381/381, 382; 181/129, 130, 135
See application file for complete search history.

(56) References Cited

U.S. PATENT DOCUMENTS

| | | | | |
|---|---|---|---|---|
| 5,606,621 | A * | 2/1997 | Reiter et al. | 381/328 |
| 7,139,404 | B2 | 11/2006 | Feeley et al. | |
| 2003/0002700 | A1* | 1/2003 | Fretz et al. | 381/330 |
| 2004/0010181 | A1 | 1/2004 | Feeley et al. | |
| 2005/0008178 | A1 | 1/2005 | Joergensen et al. | |
| 2007/0195981 | A1 | 8/2007 | Le | |
| 2009/0304216 | A1 | 12/2009 | Hansen | |
| 2011/0235834 | A1 | 9/2011 | Brimhall et al. | |

(Continued)

FOREIGN PATENT DOCUMENTS

| | | | |
|---|---|---|---|
| DE | 102008030551 | A1 | 8/2009 |
| DE | 102010040834 | A1 | 3/2012 |

OTHER PUBLICATIONS

Partial European Search Report dated Mar. 27, 2015 in connection with European Patent Application No. 14193903.3; 6 pages.

(Continued)

*Primary Examiner* — Huyen D Le

(57) ABSTRACT

A hearing aid according to an embodiment includes a hardware module, a case, and a receiver module. The hardware module is configured to control the hearing aid. The case has an open side and an internal space for accommodating the hardware module. The receiver module is united with the case to form an integrated structure. The receiver module includes a receiver connector fixedly connected at one side thereof with the case, and a receiver formed at the other side of the receiver connector. The hearing aid may further include a case interface unit fixedly formed at a closed side of the case. The hearing aids according to other embodiments are also disclosed.

16 Claims, 8 Drawing Sheets

(56) References Cited

U.S. PATENT DOCUMENTS

2012/0063621 A1 3/2012 Naumann

OTHER PUBLICATIONS

Extended European Search Report dated Aug. 24, 2015 in connection with European Patent Application No. 14193903.3; 12 pages.

* cited by examiner

HEARING AID HAVING RECEIVER

CROSS-REFERENCE TO RELATED APPLICATION(S) AND CLAIM OF PRIORITY

The present application is related to and claims the benefit under 35 U.S.C. §119(a) of a Korean patent application filed on Nov. 21, 2013 in the Korean intellectual property office and assigned serial No. 10-2013-0141884, the entire disclosure of which is hereby incorporated by reference.

TECHNICAL FIELD

The present disclosure relates to component of a hearing aid RIC (Receiver In the Canal) type having a receiver.

BACKGROUND

A hearing aid is an electro-acoustic device which is designed to amplify sound for the wearer, usually with the aim of making speech more intelligible, and to correct impaired hearing as measured by audiometry. There are many types of hearing aids (also known as hearing instruments) such as BTE (Behind The Ear), ITE (In The Ear), CIC (Completely In the Canal), RIC (Receiver In the Canal), and the like.

Among them, a hearing aid of the RIC type has a structure that a receiver is inserted in the ear. Normally the RIC hearing aid is composed of a receiver, a hardware module, a case for covering the hardware module, and an interface unit for connecting the receiver and the case. Such RIC hearing aids are often classified into an integrated style in which the receiver and the hardware module are united together, and a connected style in which the receiver and the hardware module are separable from each other. A hearing aid of the connected style further requires another interface unit for connecting the receiver and the hardware module.

When a hearing aid of the integrated style, even though only one of both the receiver and the hardware module is damaged, it may not be possible to replace only the defective with a new one. This is inefficient.

When a hearing aid of the connected style, a connecting part between the receiver and the hardware is prone to damage. For example, if a user applies much excessive force or tries to connect in a wrong direction, the connecting part is easily damaged.

SUMMARY

To address the above-discussed deficiencies, it is a primary object to provide a hearing aid which allows the disassembly of components and the simple replacement of a defective component only when a certain component is defective or damaged. Additionally, the present disclosure provides a hearing aid which can prevent connecting parts between respective components from being damaged or separated.

One embodiment of this disclosure may provide a hearing aid that includes a hardware module configured to control the hearing aid. The hearing aid also includes a case having an open side and an internal space for accommodating the hardware module. The hearing aid also includes a receiver module united with the case to form an integrated structure.

Another embodiment of this disclosure may provide a hearing aid that includes a case having an open side and an internal space. The hearing aid also includes a hardware module configured to be inserted into the case. The hearing aid also includes a receiver module united with the hardware module to form an integrated structure.

Still another embodiment of this disclosure may provide a hearing aid that includes a case having an open side and an internal space. The hearing aid also includes a hardware module configured to be inserted into the case. The hearing aid also includes a receiver interface unit configured to be connected with the hardware module. The hearing aid also includes a receiver module united with the receiver interface unit to form an integrated structure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 4C, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or method. The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

Figure 1:
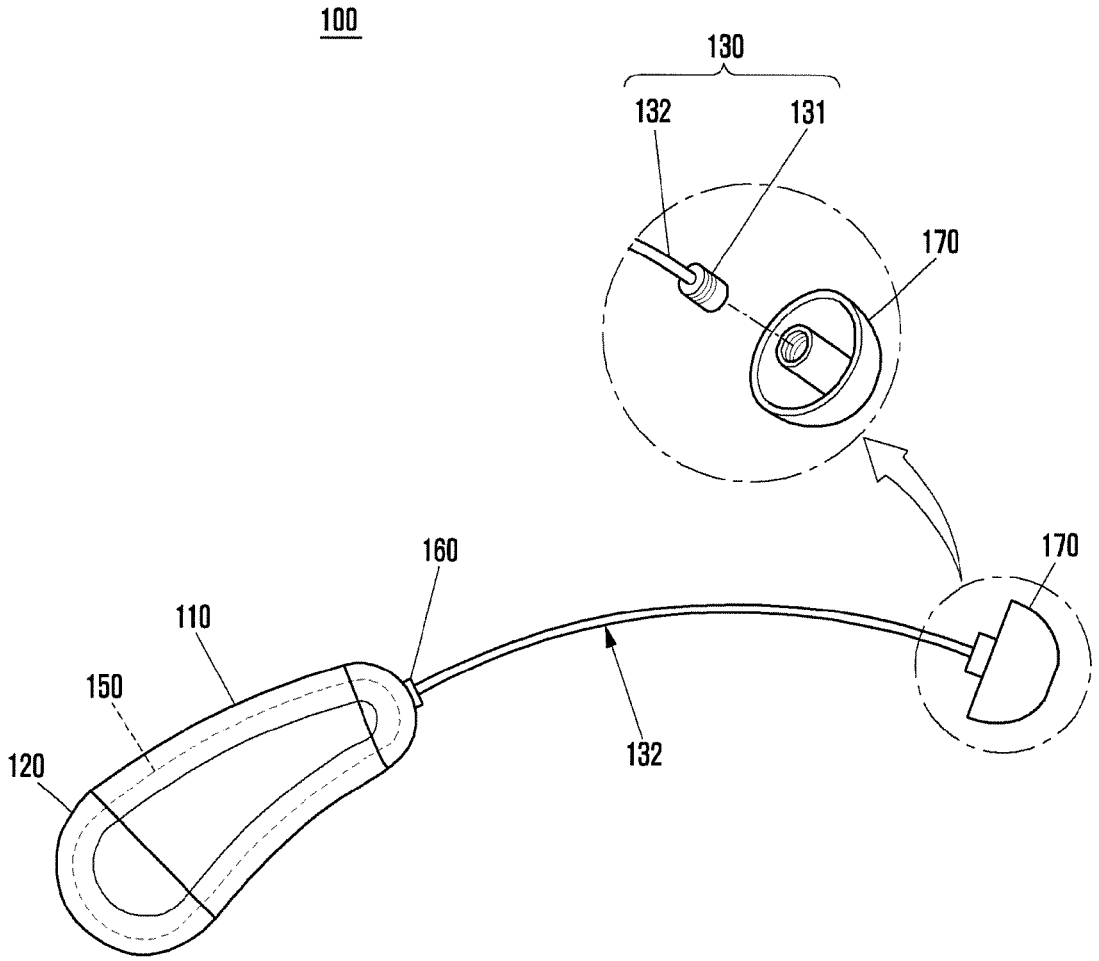
FIG. 1 illustrates a hearing aid in accordance with various embodiments of the present disclosure.

FIG. 1 illustrates a hearing aid in accordance with various embodiments of the present disclosure.

Referring to FIG. 1, the hearing aid 100 may include a case 110, a case cap 120, a receiver module 130, a hardware module 150, an interface unit 160, and an ear cap 170.

The case 110 has therein an empty space which can accommodate the hardware module 150. The case 110 may be formed solely or connected with the receiver module 130 to have an integrated form. When the case 110 is formed solely, a part of the case 110 may have a hole through which a receiver connector 132 of the receiver module 130.

The case cap 120 covers one side of the case 110, pushing the hardware module 150 into the case 110. The case cap 120 can be completely detachable from the case 110 by having the form of a threaded screw closure or can be connected to a hinged lid partly coupled to the case 110.

The receiver module 130 is composed of a receiver 131 and a receiver connector 132.

The receiver 131 is equipped at one side of the receiver connector 132. The receiver 131 may receive a signal from the hardware module 160 and output the signal.

The receiver connector 132, which may have a wire-like configuration, is connected with the receiver 131 in an integrated form. The receiver connector 132 may be made of suitable material for hanging the hearing aid 100 on a user's ear. Also, the receiver connector 132 delivers a signal amplified at the hardware module 150, to the receiver 131.

Hereinafter, it is supposed that the receiver module 130 has an integrated form of the receiver 131 and the receiver connector 132.

The hardware module 150 may be united with the receiver module 130 to have a structure of an integrated style, or solely formed and inserted into the case 110 to have a structure of a connected style. The hardware module 150 stores therein a specific program for executing a function of the hearing aid 100 and also performs a function to control the hearing aid 100.

The interface unit 160 may include at least one of a case interface unit, a hardware interface unit, and a receiver interface unit. The case interface unit is fixedly formed in the case 110, especially at a connecting part between the case 110 and the receiver connector 132, to be connected with the hardware module 150 when the receiver module 130 and the case 110 have an integrated form. This will be described below with reference to FIGS. 2A and 2B. In order to facilitate the connection with or disconnection from the hardware module 150, the case interface unit may be formed of elastic material and/or have a resilient configuration. The hardware interface unit is fixedly formed at a connecting part between the hardware module 150 and the receiver connector 132 when the receiver module 130 and the hardware module 150 have an integrated form. This will be described below with reference to FIGS. 3A and 3B. The hardware interface unit can adhere close to the case 110 when the hardware module 150 is inserted in the case 110. For a pollution control, the hardware interface unit may be covered with antipollution material. The receiver interface unit is fixedly formed at one of the receiver connector 132 when the receiver module 130 is realized solely. This will be described below with reference to FIGS. 4A to 4C. The receiver interface unit can be inserted in the case 110 and detachably connected with the hardware module 150 in the case 110.

The ear cap 170 covers the receiver 131 of the receiver module 130 and has soft characteristics adapted to be inserted into a user's ear.

Now, the above-discussed hearing aid having the receiver will be described more fully with reference to FIGS. 2 to 4.

Figure 2A:
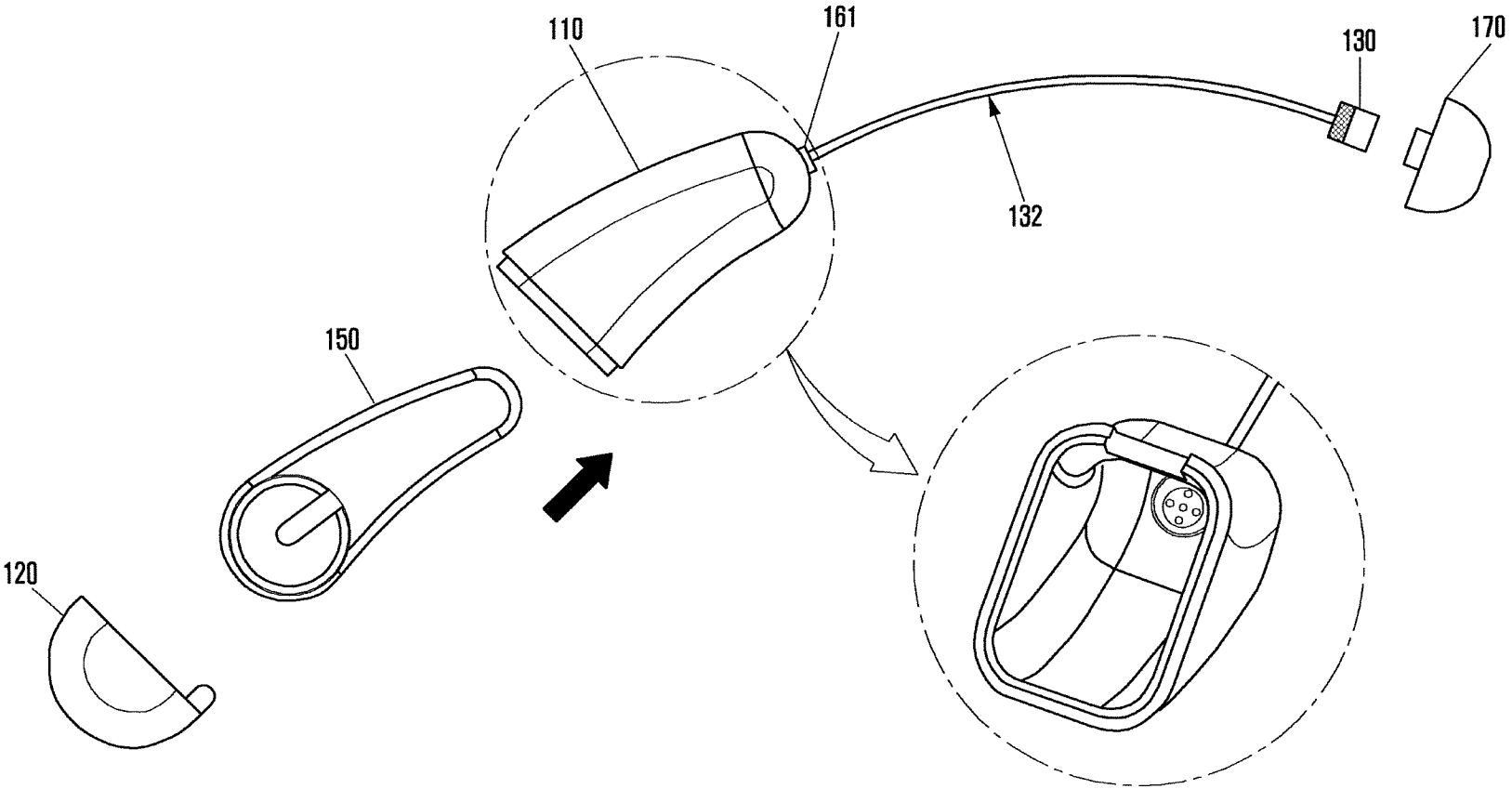
FIGS. 2A and 2B illustrate a hearing aid in accordance with an embodiment of the present disclosure.
Figure 2B:
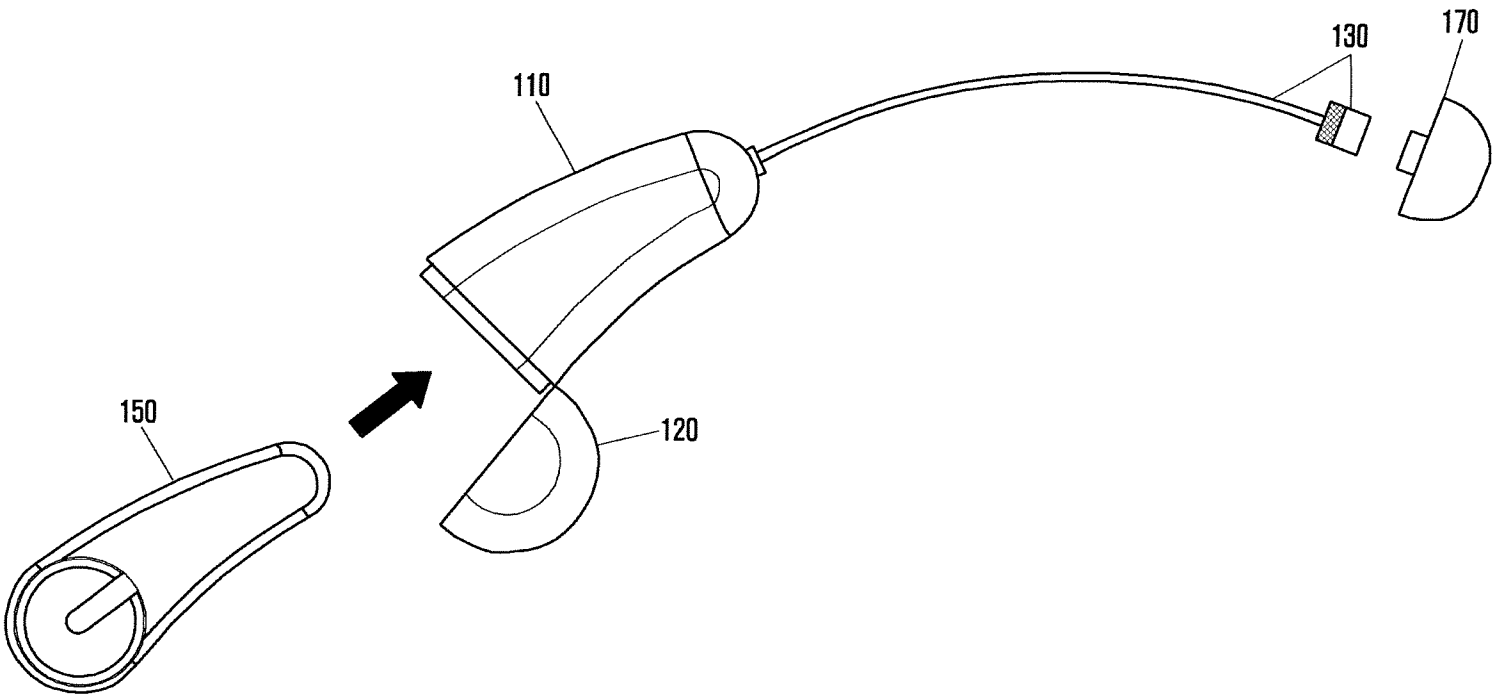

FIGS. 2A and 2B illustrate a hearing aid in accordance with an embodiment of the present disclosure. This embodiment shows an integrated structure of the receiver module 130 and the case 110.

Referring first to FIG. 2A, the case 110 is united with the receiver module 130 to form an integrated structure. The case 110 has an open side and an internal space for accommodating the hardware module 150. Also, the case 110 has a case interface unit 161 fixedly formed at a closed side thereof. Through the case interface unit 161, the case 110 can be connected with the hardware module 150. As shown in a partly enlarged view, the case interface unit 161 is formed of elastic material and/or a resilient configuration to facilitate the connection with or disconnection from the hardware module 150. This resilient configuration may be one of a pogo pin, a contact pad, a clip, and the like.

The case cap 120 covers one side of the case 110. Also, as shown, the case cap 120 can be completely detachable from the case 110 by having the form of a threaded screw closure.

The receiver module 130 is united with the case 110 to form an integrated structure. In an embodiment, the receiver connector 132 of the receiver module 130 is fixedly connected with one side of the case 110 through the case interface unit 161.

The hardware module 150 can be inserted into the case 110 and detachably connected with the receiver module 130 through the case interface unit 161.

Referring to FIG. 2B, the case cap 120 can be opened and reclosable by having the form of a hinged lid partly coupled to the case 110. After the hardware module 150 is inserted in the case 110 and connected with the case interface unit 161, the case cap 120 is closed.

Figure 3A:
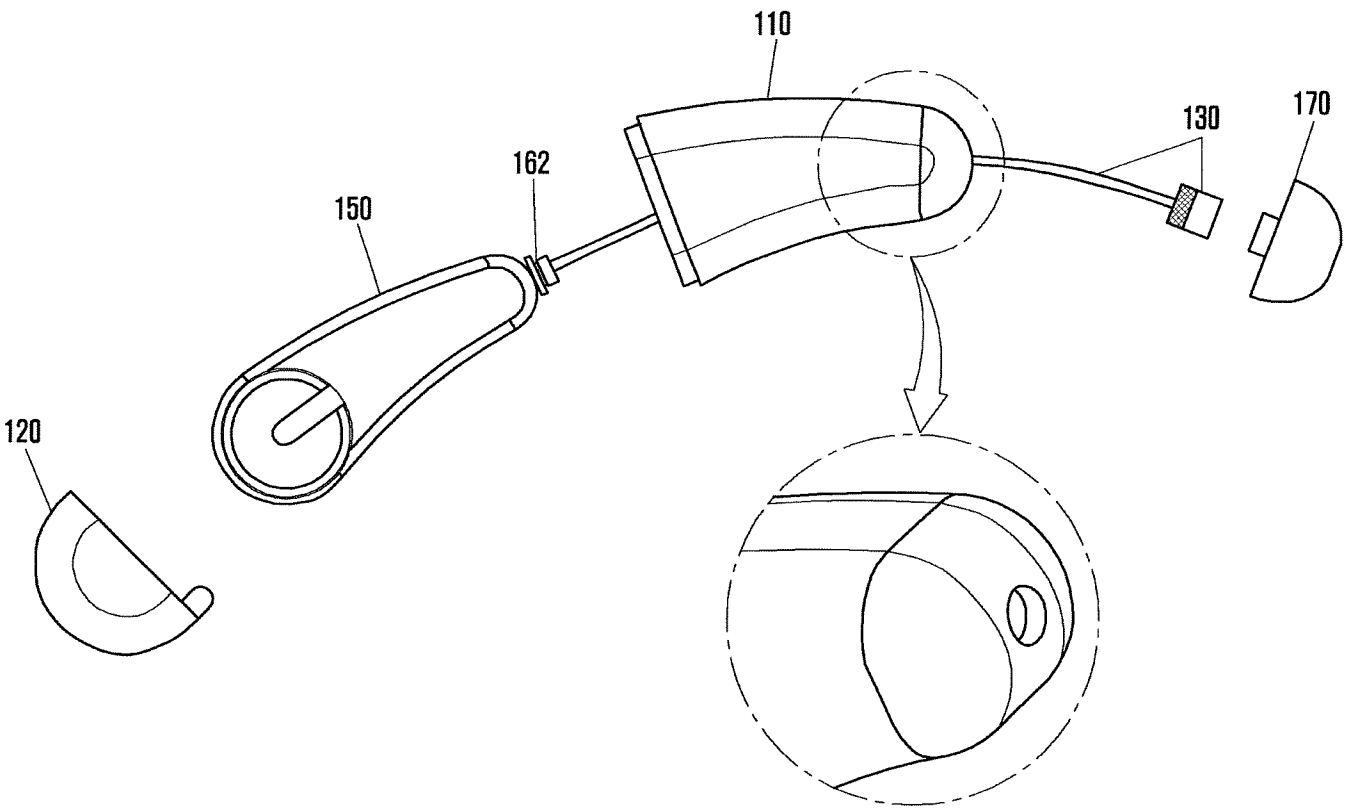
FIGS. 3A and 3B illustrate a hearing aid in accordance with another embodiment of the present disclosure.
Figure 3B:
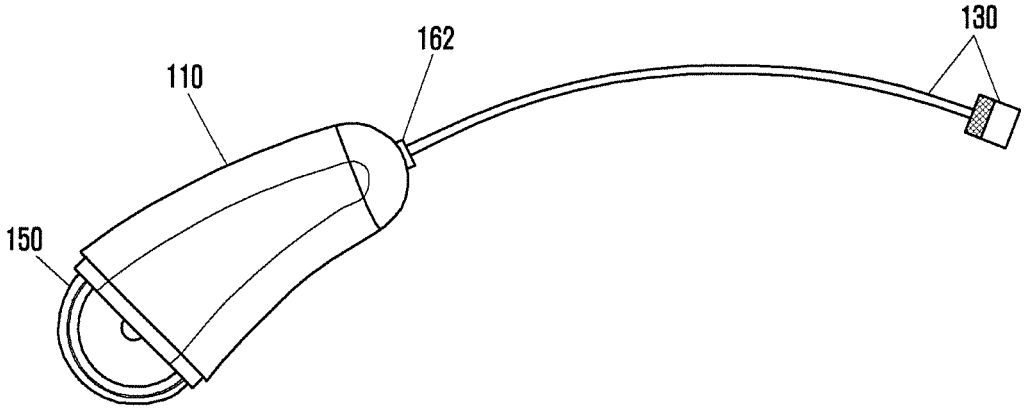

FIGS. 3A and 3B illustrate a hearing aid in accordance with another embodiment of the present disclosure. This embodiment shows an integrated structure of the receiver module 130 and the hardware module 150.

Referring first to FIG. 3A, the case 110 has an open side and an internal space for accommodating the hardware module 150. Also, the case 110 has a hole formed at a closed side thereof and designed to allow a passage of the receiver module 130. This hole has a size smaller than that of a hardware interface unit 162 and greater than that of the receiver module 130. Therefore, this hole allows a passage of the receiver module 130 and disallows a passage of the hardware module 150. For a pollution control, this hole may be coated with antipollution material.

The case cap 120 covers one side of the case 110. Also, the case cap 120 can be completely detachable from the case 110 as shown by having the form of a threaded screw closure, or can be opened and reclosable by having the form of a hinged lid partly coupled to the case 110.

The receiver module 130 is united with the hardware module 150 to have an integrated structure. For example, the receiver module 130 and the hardware module 150 may be fixedly connected with each other through soldering or any other fastening technique. The hardware interface unit 162 is fixedly formed at a connecting part between the hardware module 150 and the receiver module 130. For a pollution control and a waterproof purpose, the hardware interface unit 162 as well as the aforesaid hole of the case 110 may be coated with antipollution material.

FIG. 3B shows a state after the hardware module 150 is assembled into the case. Referring to FIG. 3B, when an integrated structure of the receiver module 130 and the hardware module 150 is inserted into the case 110, the hole of the case 110 may only allow a passage of the receiver module 130. Therefore, the hardware module 150 can adhere close to the case 110 due to the hardware interface unit 162 blocking up the hole of the case 110. Antipollution material which coats the hardware interface unit 162 and the hole of the case 110 may prevent undesirable pollution in the case 110 and unwished water inflow into the case 110.

Figure 4A:
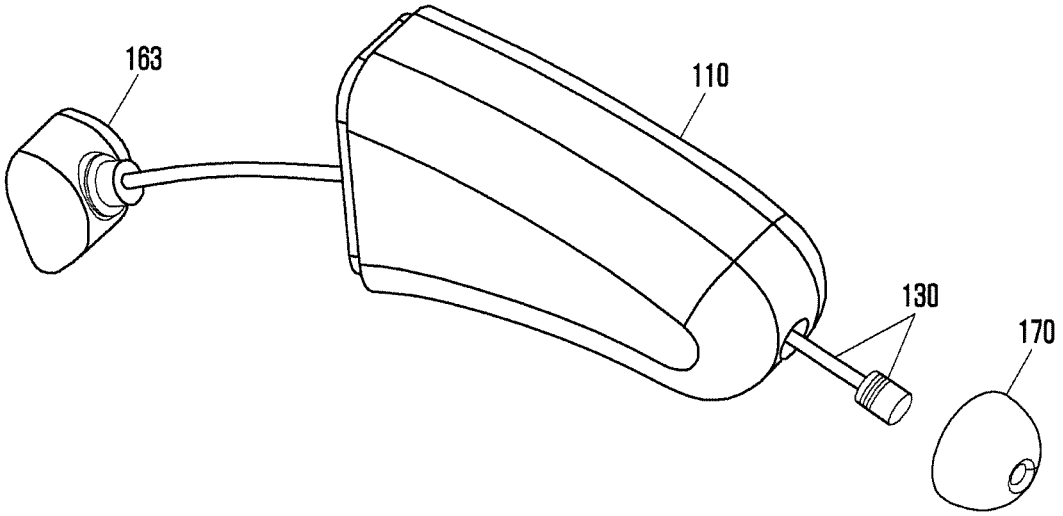
FIGS. 4A to 4C illustrate a hearing aid in accordance with still another embodiment of the present disclosure.
Figure 4B:
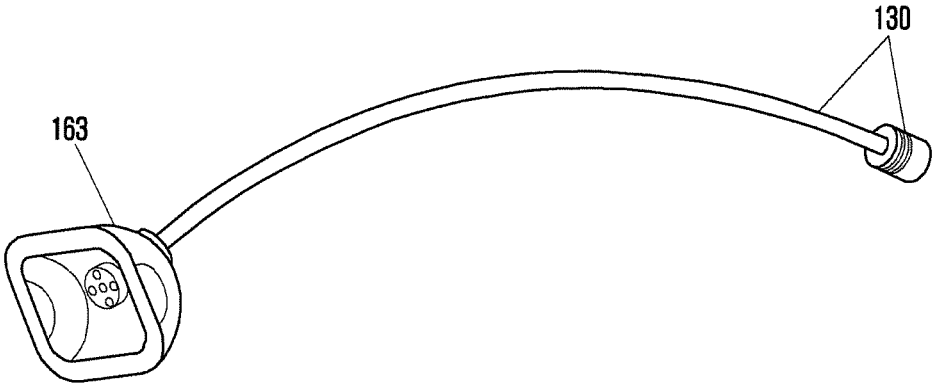
Figure 4C:
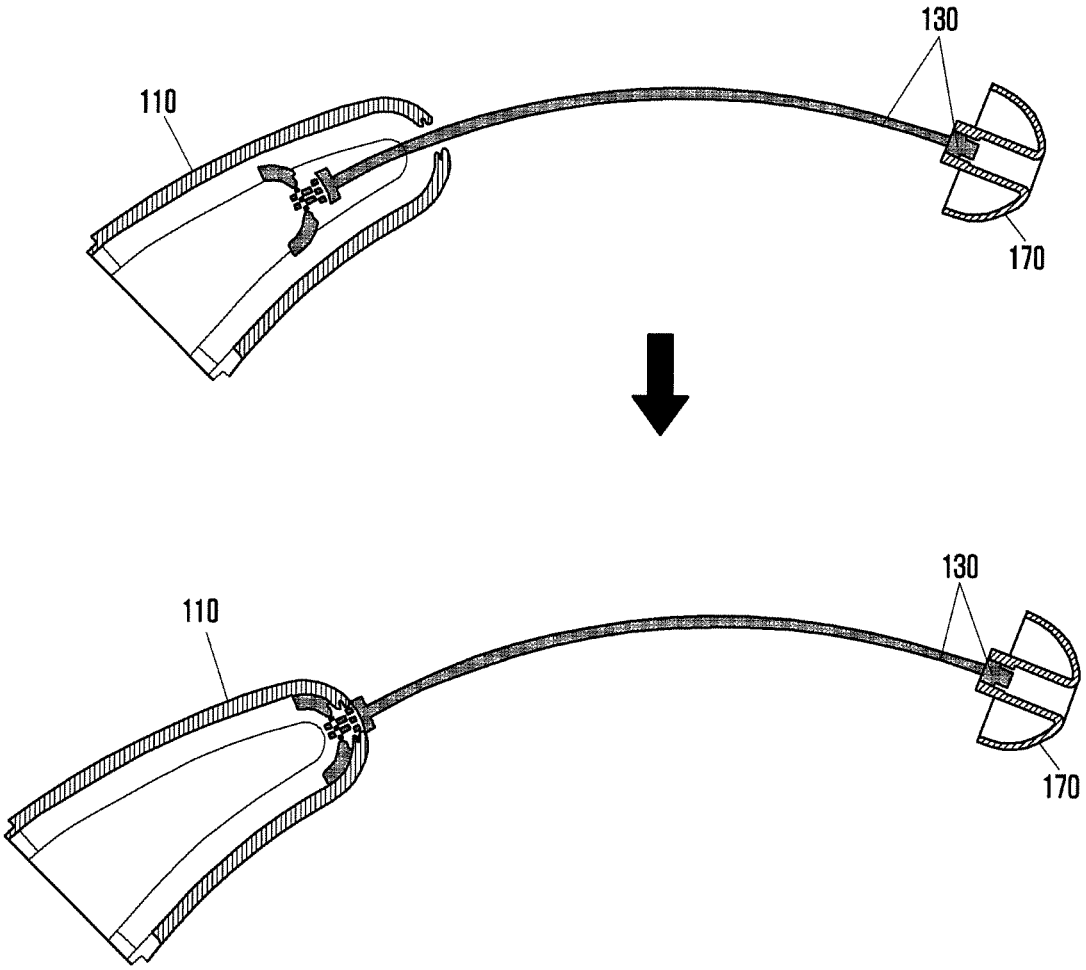

FIGS. 4A to 4C illustrate a hearing aid in accordance with still another embodiment of the present disclosure. This embodiment shows a solely formed structure of the receiver module 130.

Referring first to FIG. 4A, the receiver module 130 is united with a receiver interface unit 163 formed at one side thereof. The receiver module 130 may be combined with the hardware module (not shown, e.g., 150 in any previous drawing) through the receiver interface unit 163. Then the hardware module 150 can be inserted into the case 110. The receiver module 130 is detachably connected at the other side thereof with the ear cap 170.

The case 110 has a hole which has a size smaller than that of the receiver interface unit 163 and greater than that of the receiver module 130. Therefore, this hole allows a passage of the receiver module 130 and disallows a passage of the receiver interface unit 163. In order to prevent undesirable pollution in the case 110 and unwished water inflow into the case 110, the receiver interface unit 163 may be coated with antipollution material. Similarly, the hole of the case 110 may also be coated with antipollution material.

FIG. 4B shows the receiver module 130 and the receiver interface unit 163 at other angle. The receiver interface unit 163 may be formed of elastic material and/or a resilient configuration to facilitate the connection with or disconnection from the hardware module (not shown, e.g., 150 in any previous drawing). For example, the receiver interface unit 163 may have resilient configuration such as a pogo pin, a contact pad, a clip, or any other equivalent at a connecting part with the hardware module 150.

FIG. 4C is a cross-sectional view showing the hearing aid in this embodiment. As shown in FIG. 4C, the receiver module 130 is united with the receiver interface unit 163 formed at one side thereof and can be connected with the hardware module (not shown, e.g., 150 in any previous drawing) through the receiver interface unit 163 in the case 110. The case 110 has a hole the size of which is smaller than that of the receiver interface unit 163 and greater than that of the receiver module 130. Therefore, the receiver module 130 having the receiver interface unit 163 can pass through this hole and then adhere close to the case 110. Namely, while allowing a passage of the receiver module 130, the case 110 disallows a passage of the receiver interface unit 163 at the hole thereof. Thereafter, the hardware module 150 can be inserted into the internal space of the case 110 through an open side of the case 110. Then the case cap (not shown, e.g., 120 in any previous drawing) can cover the open side of the case 110.

The ear cap 170 is combined with the other side of the receiver module 130.

As discussed hereinbefore, the hearing aids according to various embodiments can enhance efficiency in the disassembly of components such as the receiver and the others and also allow the simple replacement of a defective component. Further, the hearing aids in various embodiments can prevent connecting parts between respective components from being damaged or separated.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A hearing aid comprising:

a hardware module configured to control the hearing aid;

a case comprising an open side, and an internal space for accommodating the hardware module;

a case cap configured to cover the open side of the case, wherein the case and the case cap enclose the hardware module, and wherein the open side of the case allows removal of the hardware module;

a receiver module united with the case to form an integrated structure; and a case interface unit fixedly formed at a closed side of the case and formed of elastic material.

2. The hearing aid of claim 1, wherein the case cap is configured to be detachable from the case by having a form of a threaded screw closure or to be opened by having a form of a hinged lid partly coupled to the case.

3. The hearing aid of claim 1, wherein the receiver module includes a receiver connector fixedly connected at one side thereof with the case, and a receiver formed at the other side of the receiver connector.

4. The hearing aid of claim 1, wherein the case interface unit includes a resilient configuration to facilitate a connection with or disconnection from the hardware module, wherein the resilient configuration is one of a pogo pin, a contact pad, and a clip.

5. A hearing aid comprising:

a case comprising an open side and an internal space;

a hardware module configured to be inserted into the case;

a case cap configured to cover the open side of the case, wherein the case and the case cap enclose the hardware module, and wherein the open side of the case allows removal of the hardware module; and a receiver module united with the hardware module to form an integrated structure, wherein the case comprises a hole formed at a closed side thereof, the hole is a size greater than the receiver module to allow the receiver module to pass through the hole.

6. The hearing aid of claim 5, wherein the case cap is configured to be detachable from the case by having a form of a threaded screw closure or to be opened by having a form of a hinged lid partly coupled to the case.

7. The hearing aid of claim 5, wherein the receiver module includes a receiver connector fixedly connected at one side thereof with the hardware module, and a receiver formed at the other side of the receiver connector.

8. The hearing aid of claim 5, wherein the case is coated with antipollution material.

9. The hearing aid of claim 5, further comprising:

a hardware interface unit fixedly formed between the hardware module and the receiver module.

10. The hearing aid of claim 9, wherein the hardware interface unit is fixedly connected with the receiver module through soldering or other fastening technique, configured to adhere close to a hole formed at the case, and coated with antipollution material.

11. A hearing aid comprising:

a case comprising an open side and an internal space;

a hardware module configured to be inserted into the case;

a receiver interface unit configured to be connected with the hardware module;

a receiver module united with the receiver interface unit to form an integrated structure; and a case cap configured to cover the open side of the case and to be detachable from the case, wherein the case and the case cap enclose the hardware module, and wherein the open side of the case allows removal of the hardware module, wherein the case comprises a hole formed at a closed side thereof, the hole is a size greater than that of the receiver module and smaller than that of the receiver interface unit.

12. The hearing aid of claim 11, wherein the receiver module includes a receiver connector fixedly connected at one side thereof with the receiver interface unit, and a receiver formed at the other side of the receiver connector.

13. The hearing aid of claim 11, wherein the case is coated with antipollution material.

14. The hearing aid of claim 11, wherein the receiver interface unit is formed of elastic material or a resilient configuration to facilitate a connection with or disconnection from the hardware module, wherein the resilient configuration is one of a pogo pin, a contact pad, and a clip.

15. The hearing aid of claim 11, wherein the receiver interface unit is fixedly connected with the receiver module through soldering or other fastening technique, and configured to adhere close to a hole formed at the case.

16. The hearing aid of claim 11, wherein the receiver interface unit is coated with antipollution material.

* * * * *